US008176587B2

(12) United States Patent
Matt et al.

(10) Patent No.: US 8,176,587 B2
(45) Date of Patent: May 15, 2012

(54) FOLDING HEADREST DEVICE FOR MASSAGE

(76) Inventors: David J Matt, Long Beach, CA (US); Kevin Gard, Long Beach, CA (US)

( * ) Notice: Subject to any disclaimer, the term of this patent is extended or adjusted under 35 U.S.C. 154(b) by 0 days.

(21) Appl. No.: 13/098,793

(22) Filed: May 2, 2011

(65) Prior Publication Data

US 2011/0296620 A1 Dec. 8, 2011

Related U.S. Application Data

(60) Provisional application No. 61/397,027, filed on Jun. 7, 2010.

(51) Int. Cl.
*A47C 20/02* (2006.01)

(52) U.S. Cl. ..... 5/640; 5/638; 5/643; 5/661; 5/659

(58) Field of Classification Search ..... 5/661, 659, 5/658, 640, 643, 638, 636, 622
See application file for complete search history.

(56) References Cited

U.S. PATENT DOCUMENTS

| | | | | |
|---|---|---|---|---|
| 6,148,460 | A * | 11/2000 | Fried et al. | 5/661 |
| 6,151,734 | A * | 11/2000 | Lawrie | 5/640 |
| 6,928,679 | B1 * | 8/2005 | Gross | 5/638 |
| 7,036,168 | B1 * | 5/2006 | Knickerbocker | 5/640 |
| 2011/0296620 | A1 * | 12/2011 | Gard et al. | 5/661 |

* cited by examiner

*Primary Examiner* — Robert G Santos

(57) ABSTRACT

A folding headrest product for massage consisting of an upper plate with a cushion attached thereto for the purpose of placing a massage receiver's head face-down. A height adjustment and locking element located on a downwardly extending male portion that is attached to said upper plate with a rotatable mounted mechanism for the purpose of rotating said upper plate generally 180-degrees. A height adjustment and locking element located on an upwardly extending female portion that receives said downwardly extending male portion. A lower plate portion for inserting between a mattress and box spring of a typical bed that meets said upwardly extending female portion at a generally 90-degree angle. A hanger element located on said upwardly extending female portion for the purpose of hanging said product on a closet pole.

3 Claims, 13 Drawing Sheets

FOLDING HEADREST DEVICE FOR MASSAGE

FIELD OF THE INVENTION

The inventions described below relate to the field of massage table headrests, and, more particularly, to a massage table headrest that inserts between the mattress and box spring of a typical bed.

BACKGROUND OF THE INVENTION

It is common for people to lay down on a flat surface while receiving a massage. One such flat surface is a massage table specifically designed and intended for administering and receiving massages. It is typical that such tables include an outwardly extending headrest portion. Upon such headrest portion, the recipient places their head in order to create improved alignment of spine, shoulders, neck and head. Various U.S. patents have been issued for inventions pertaining to the various embodiments of a massage table and headrest, many of which disclose massage tables assemblies that are expensive, heavy, and bulky.

Another such flat surface that people lay down on while receiving a massage is a typical bed. U.S. Pat. No. 6,148,460, entitled "Massage and Therapeutic Bed Extension Device", issued Mar. 2, 1999 to Fried, et al., describes a massage headrest device that inserts between a mattress and box spring of a typical bed. This invention assertedly provides improved back alignment for the massage recipient while laying on a bed, but undesirably requires multiple fasteners and a cross-member support brace, fails to embody a folding element for compact storage and transport convenience, fails to provide an expedient height-adjustment mechanism to accommodate varying mattress heights, fails to be engineered for lightweight construction; fails to be consumer-friendly; and is generally cumbersome and bulky. The invention described below is engineered without the use of cross-member support braces and adjustable fasteners, and requires no assembly by the end-user.

What is needed is a foldable, massage table headrest that overcomes the deficiencies in the prior art that is lightweight, easily stored and relatively inexpensive to fabricate.

SUMMARY OF THE INVENTION

The invention described herein generally comprises a rotatably mounted mechanism enabling the apparatus to fold onto itself and into a compact state, providing convenient storage and transport capability. The invention may further comprise a downwardly extending male portion and upwardly extending female portion, upon which an expedient height-adjustment mechanism is provided that requires no end-user dismantling or assembly.

The folding headrest of the invention is comprised of an upper plate portion with a headrest cushion attached thereto; a downwardly extending male portion extending there from that contains a height adjustment element; a rotatable mechanism that joins the upper plate portion to the downwardly extending male portion that allows the apparatus to fold over onto itself, beneficially resulting in the apparatus reducing its size in half.

The preferred embodiment is further comprised of a lower plate portion to be inserted between, for instance, a mattress and box-spring that has an upwardly extending female portion that contains a height adjustment element; said upwardly extending female portion that contains a hanger element that allows the apparatus to be hung in a closet.

The invention and its various embodiments can now be better understood by turning to the following description of the preferred embodiments which are presented as illustrated examples of the invention in any subsequent claims in any application claiming priority to this application. It is expressly understood that the invention as defined by such claims may be broader than the illustrated embodiments described below.

DETAILED DESCRIPTION OF THE INVENTION

Figure 1:
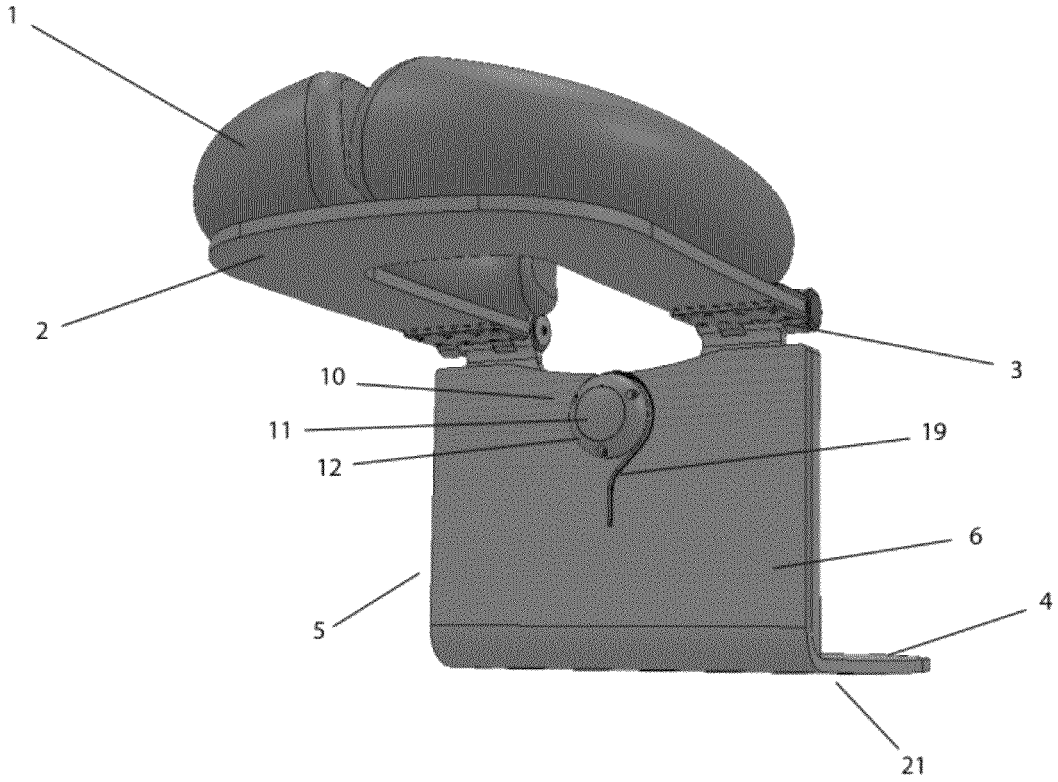
FIG. 1 is a forward perspective view of the folding headrest product for massage in an unfolded state.
Figure 2:
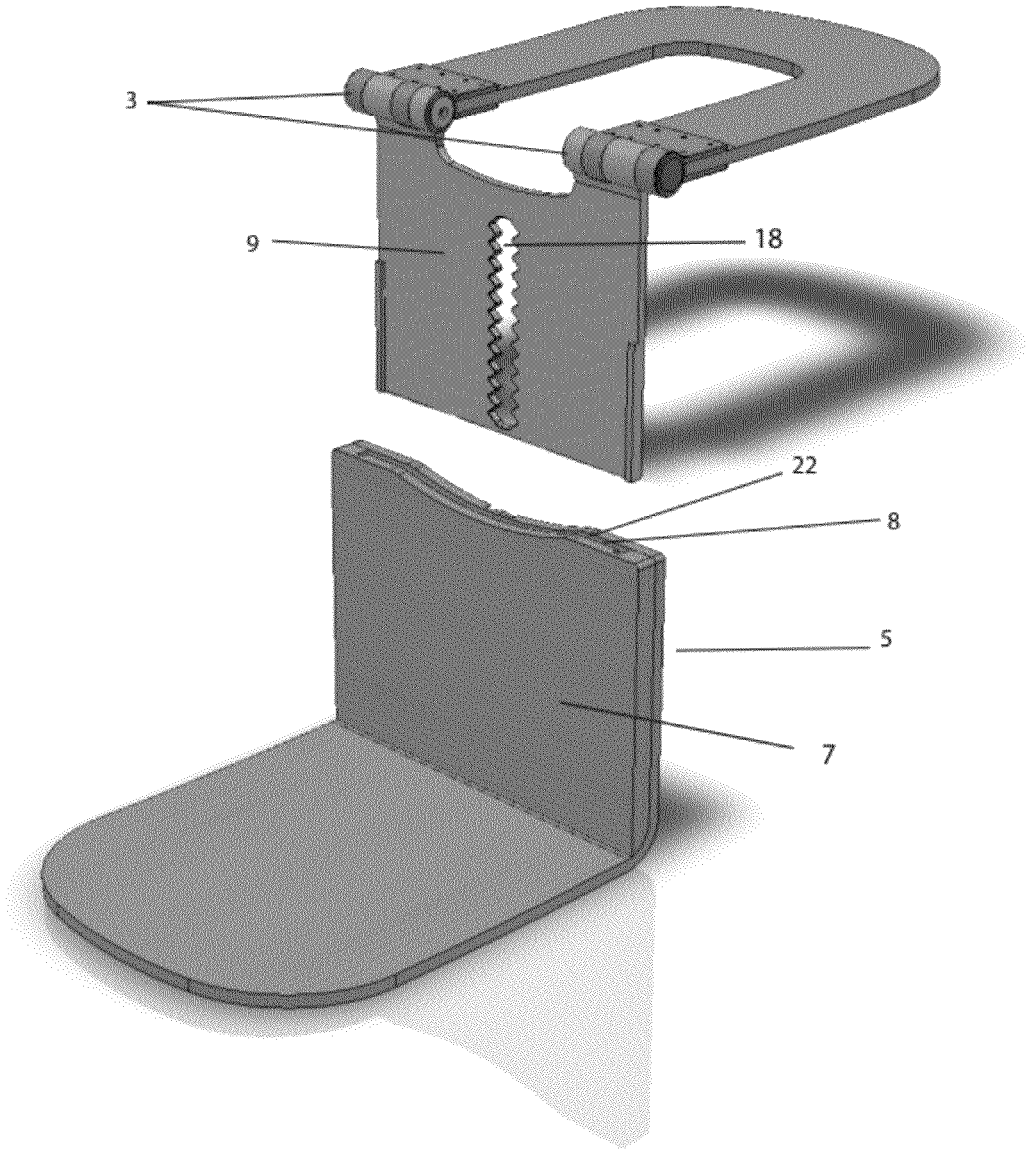
FIG. 2 is a rear perspective view of the apparatus of FIG. 1, exposing the downwardly extending male portion outside of the upwardly extending female portion; shown without the headrest portion.

Turning now to the figures wherein like references define like elements among the several views, FIG. 1 shows a forward perspective view of the folding headrest of the invention used, for instance, for massage in an unfolded state. The apparatus may comprise a Cushion 1 for a massage receiver's head to rest upon. Cushion 1 is attached to an Upper Plate 2 in any number of ways such as by adhesive, hook and loop, screws, etc. Referring briefly to FIG. 2, Upper Plate 2 attaches to a Downwardly Extending Male Portion 9 by way of Right and Left Hinges 3. Right and Left Hinges 3 are rotatably mounted mechanisms that permit Upper Plate 2 to rotate, in this embodiment, 180 degrees from an outward unfolded position to a backward folded position.

As shown in FIG. 1, means for bracing a Cushion 1 in the unfolded position may include any suitable bracing means, such as Right and Left Hinges 3. In a preferred embodiment, as shown in FIGS. 13*a-d*, Right and Left Hinges 3 are comprised of a Slat Hinge Portion 23 of Downwardly Extending Male Portion 9, Flange Hinge Element 30, Core Hinge Element 31, Cap Hinge Element 32, and Cap Screw Element 33.

Figure 3:
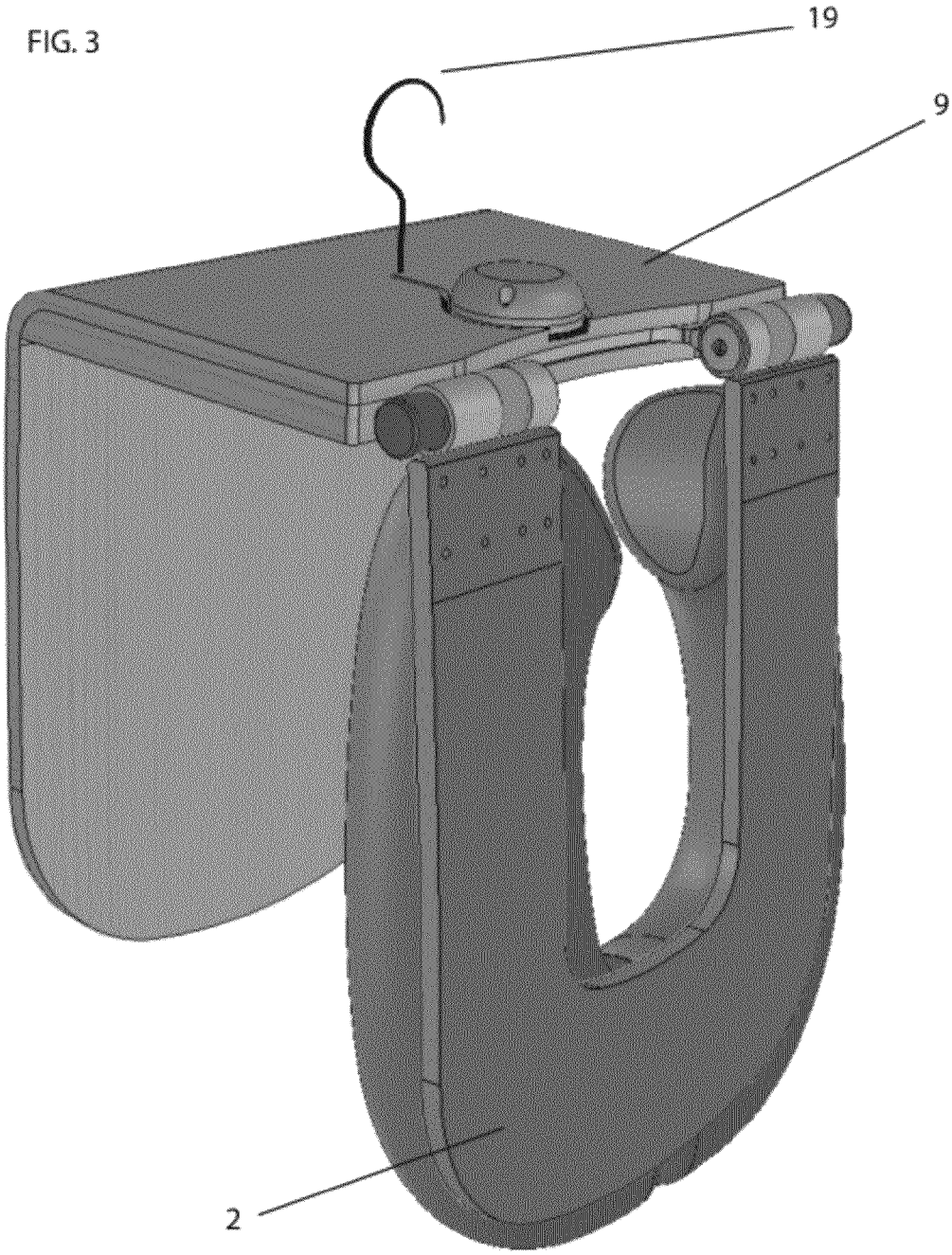
FIG. 3 is a rear perspective view of the apparatus of FIG. 1, showing the apparatus folded over onto itself.

FIG. 3 shows Upper Plate 2 folded backward on top of itself. When folded backward on top of itself, the apparatus is reduced in length by about 50%, providing for storage and transport convenience. In either the unfolded position, as shown in FIG. 1, or the folded position, as shown in FIG. 3, Upper Plate 2 extends away from Downwardly Extending Male Portion 9 at about a 90-degree angle.

Figure 11:
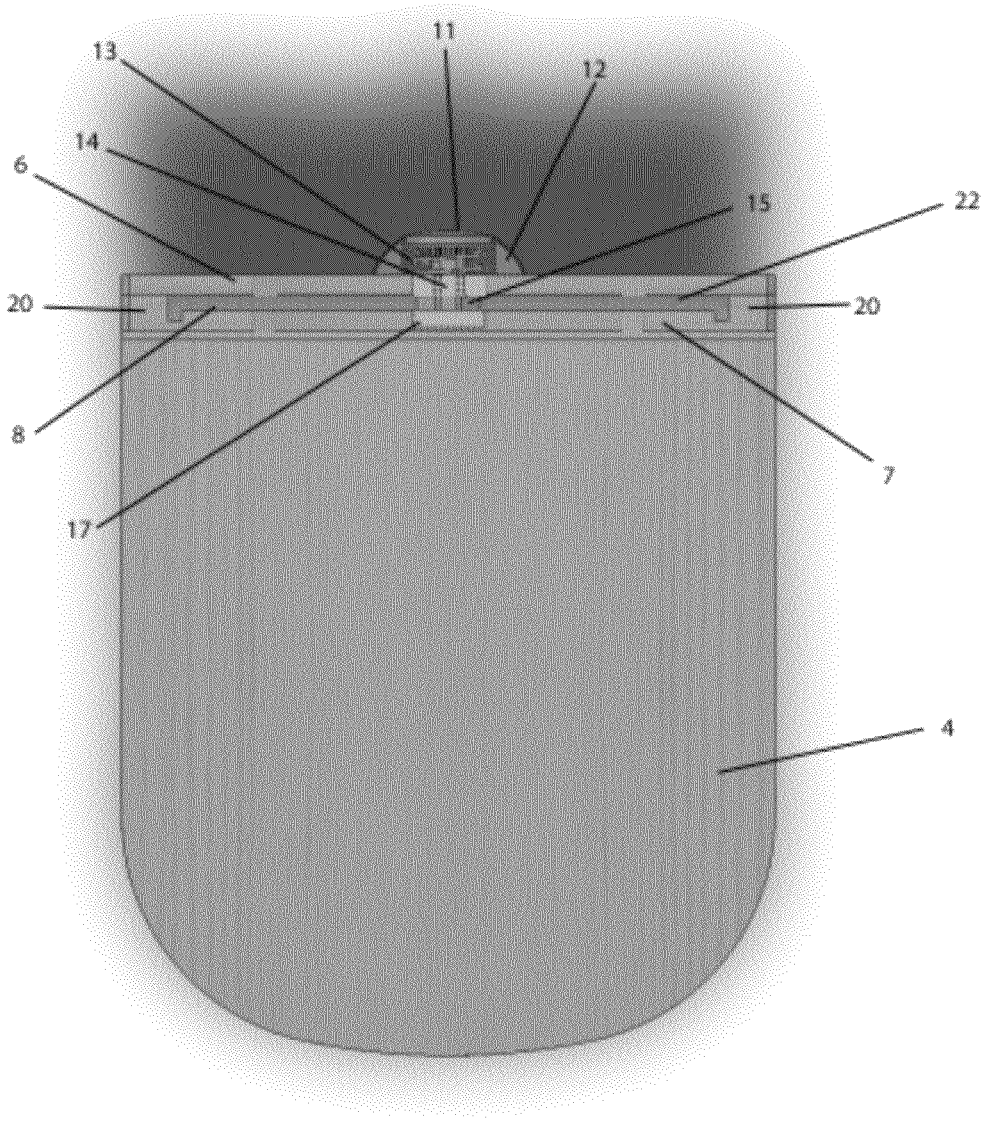
FIG. 11 is a view of the lower plate portion and upwardly extending female portion of FIG. 1, and the mechanism of FIG. 5; the lock mechanism is shown in its resting position.

Referring to FIG. 11, Upwardly Extending Female Portion 5 is comprised of a Front Wall 6 and a Rear Wall 7. Rear Wall 7 includes Side Wall Portions 20, which are built out away from Rear Wall 7 at a distance slightly further than the thickness of Downwardly Extending Male Portion 9, as displayed in FIGS. 9 & 11. As displayed again in FIG. 11, when Front Wall 6 and Rear Wall 7 are joined together, Female Cavity 22 is formed within Upwardly Extending Female Portion 5 for the purpose of receiving Downwardly Extending Male Portion 9 at Wall Opening 8.

Referring again to FIG. 2, Downwardly Extending Male Portion 9 inserts downwardly into Female Cavity 22 of Upwardly Extending Female Portion 5 at Wall Opening 8. FIG. 1 shows Upwardly Extending Female Portion 5 with Downwardly Extending Male Portion 9 contained therein.

Refer to FIG. 2 for a view of an exposed Downwardly Extending Male Portion 9 outside of Upwardly Extending Female Portion 5.

FIG. 1 shows Upwardly Extending Female Portion 5 meeting Lower Plate 4 at a generally 90-degree angle at Meeting Point 21. Lower Plate 4 extends outwardly and away from Upwardly Extending Female Portion 5. In the unfolded state shown in FIG. 1, Lower Plate 4 inserts between, for instance, a mattress and box spring of a typical bed.

Referring again to FIGS. 1 and 2, height adjustment means is provided to permit vertical adjustment of the Upper Plate 2 relative to Lower Plate 4 whereby a user can adjust the height of Cushion 1 depending on personal preference or mattress thickness. In the preferred embodiment, height adjustment means comprises a Push Button 11 and Bezel 12 of Height Adjustment Mechanism 10 as is shown on the forward facing Front Wall 6 of Upwardly Extending Female Portion 5. Height Adjustment Mechanism 10 is used for adjusting the height of Downwardly Extending Male Portion 9 in order for Cushion 1 to be positioned at the same height as the surface of a mattress, thereby properly aligning the massage receiver's head with the rest of their body as they lay on top of the mattress.

Figure 5:
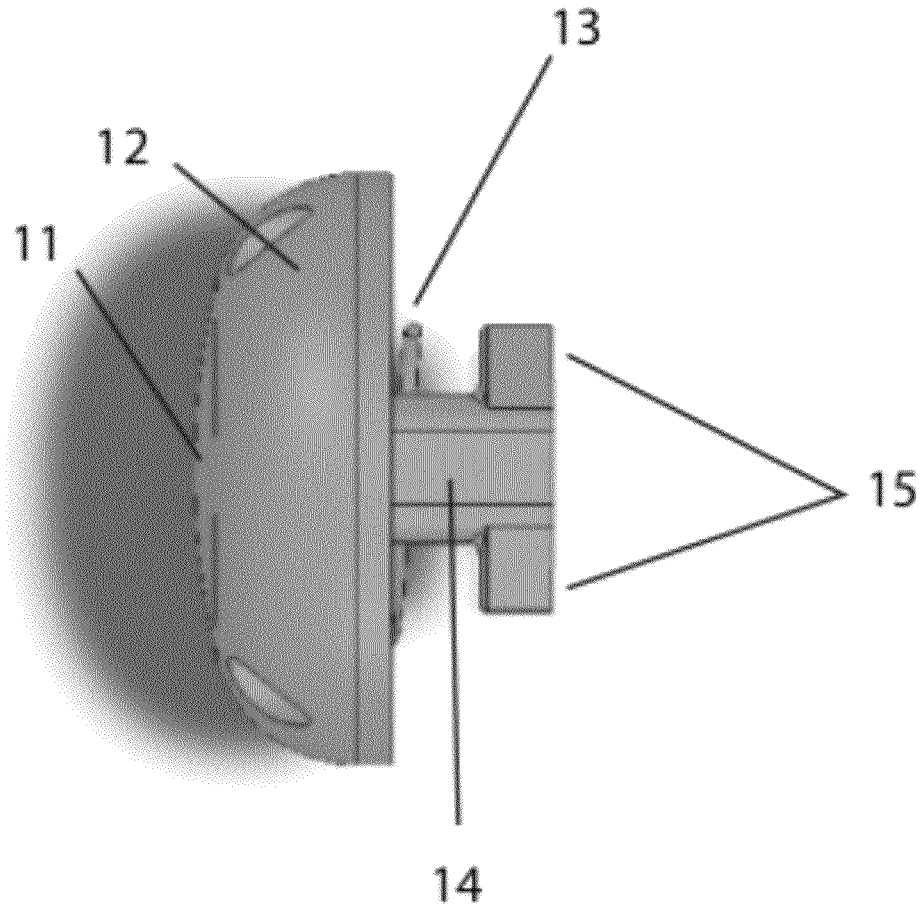
FIG. 5 is illustrates a perspective view of the mechanism of FIG. 4.
Figure 8:
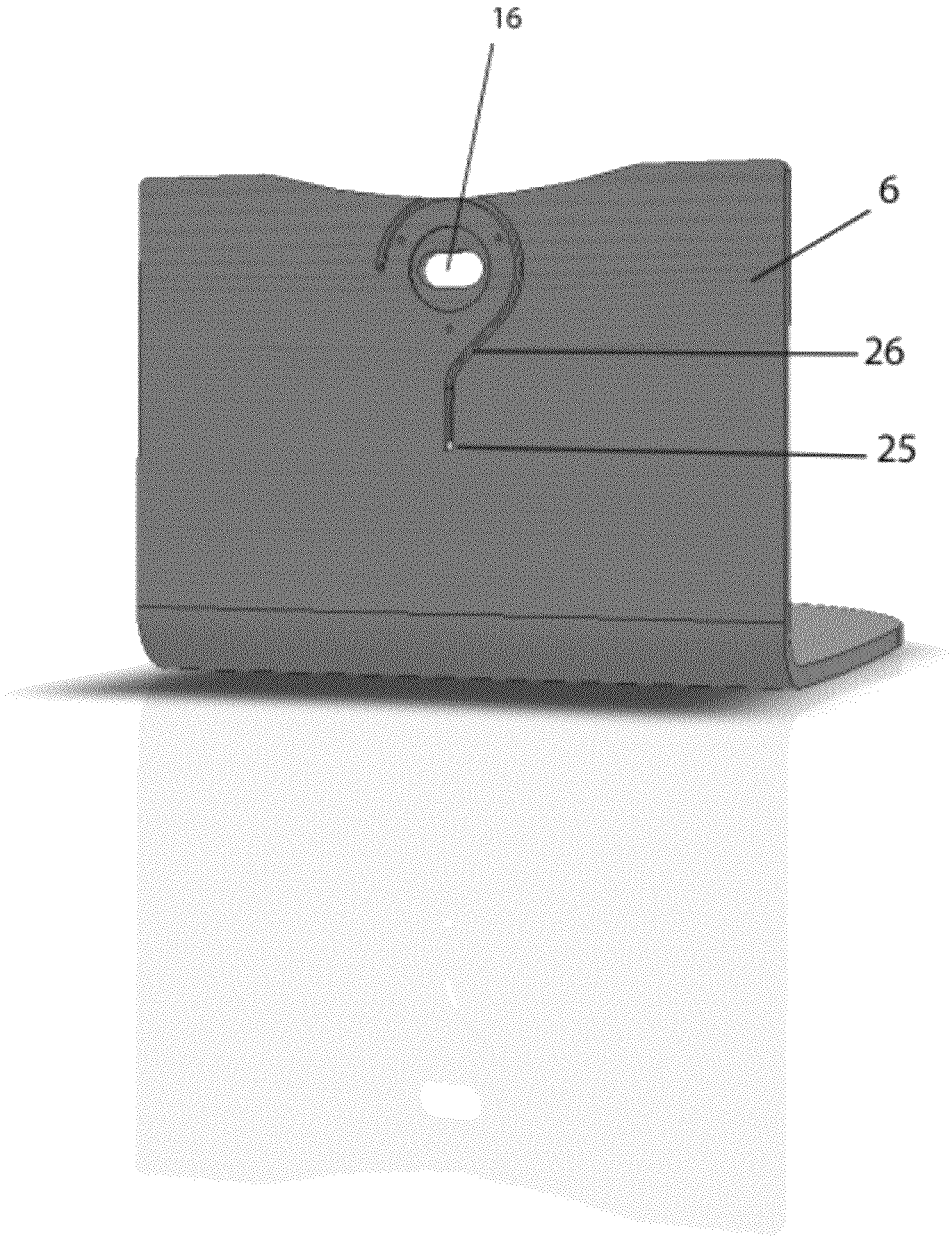
FIG. 8 is a forward perspective view of the upwardly extending female portion of the apparatus of FIG. 1; shown without any other parts.
Figure 9:
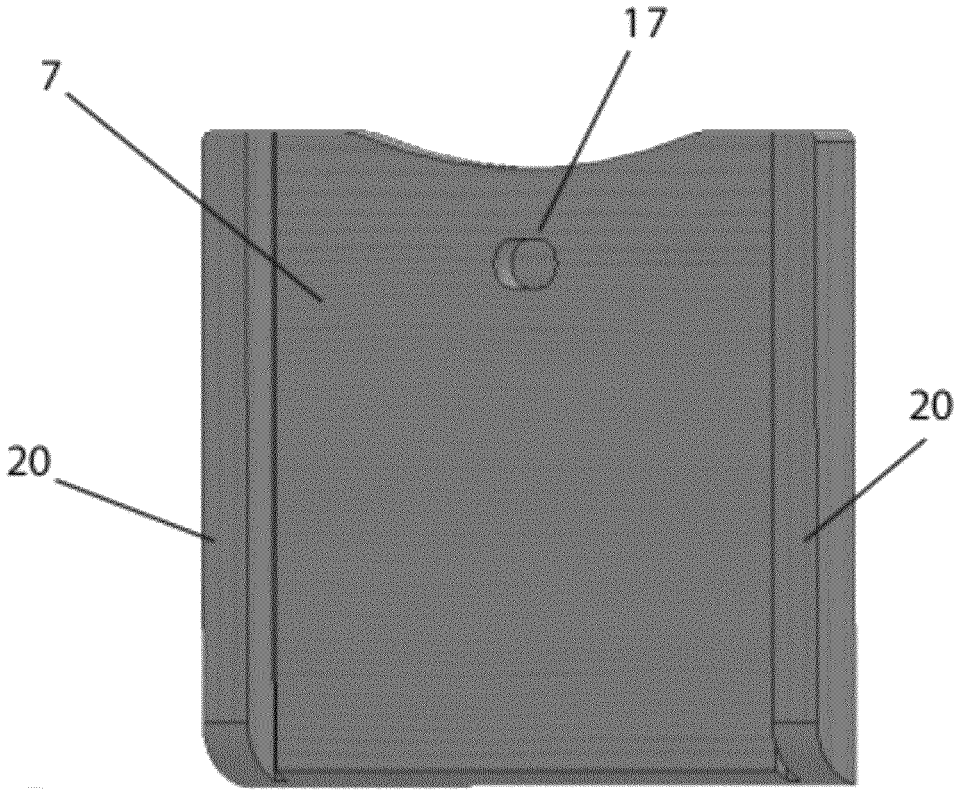
FIG. 9 is a forward perspective view of the interior surface of the upwardly extending female portion rear wall of the apparatus of FIG. 1; shown without any other parts.

Referring to FIG. 5, Height Adjustment Mechanism 10 elements contained on the Upwardly Extending Female Portion 5 are, in the illustrated embodiment, a Push Button 11, Bezel 12, Spring 13, Lock Mechanism Stem 14, Lock Mechanism Diamond Tooth 15, and briefly referring to FIG. 8, a Front Wall Pass-Trough 16, and briefly referring to FIG. 9, a Rear Wall Tooth Bay 17. Briefly referring to FIG. 2, the Height Adjustment Mechanism 10 component contained on Downwardly Extending Male Portion 9 is Height Adjustment Tooth Slots 18. Height Adjustment Tooth Slots 18 is a vertically aligned series of apertures, here shown as diamond-shaped cut-outs located on the Downwardly Extending Male Portion 9.

During assembly by a manufacturer, Downwardly Extending Male Portion 9 inserts downwardly into Female Cavity 22 of Upwardly Extending Female Portion 5 prior to attaching the Push Button 11, Bezel 12, and Spring 13 of Height Adjustment Mechanism 10.

Referring again to FIG. 5, Push Button 11 is preferably a spring-loaded lock mechanism comprised of a Lock Mechanism Stem 14 and Lock Mechanism Diamond Tooth 15 but may comprise any equivalent structure. A Bezel 12 encircles and contains Push Button 11 by, referring briefly to FIG. 1, attaching to Front Wall 6 of Upwardly Extending Female Portion 5 with common screws.

Figure 4:
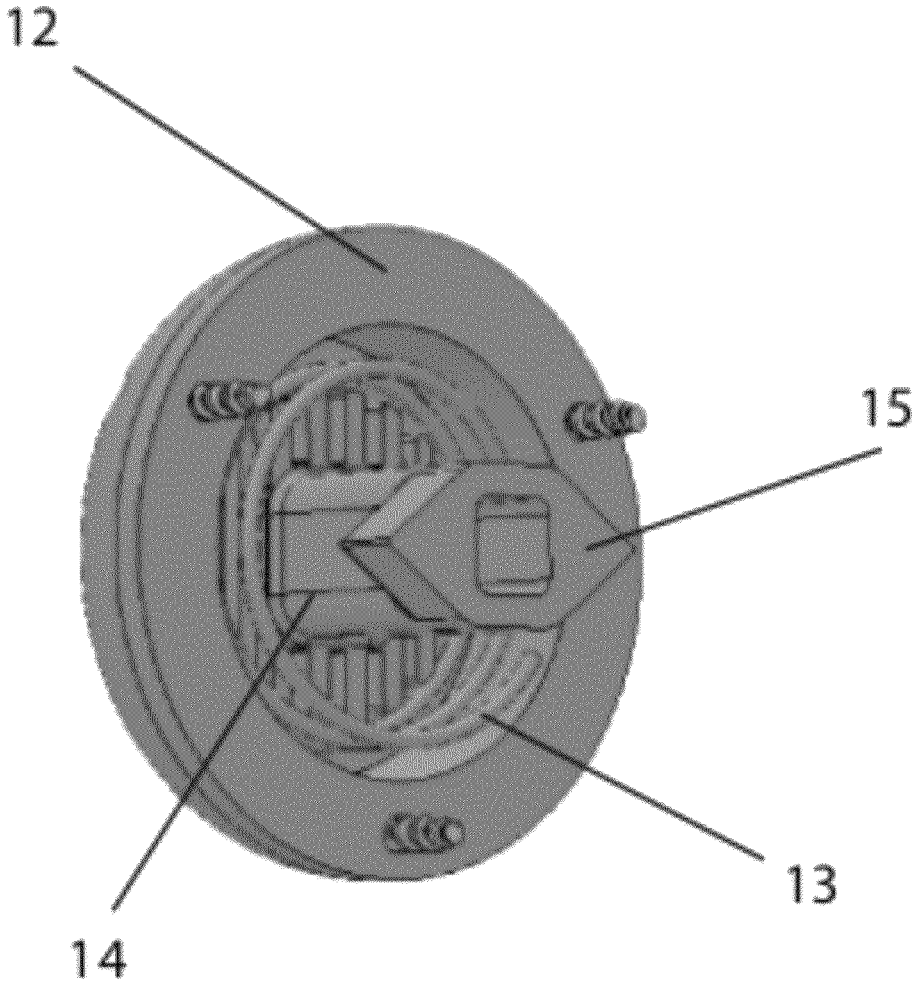
FIG. 4 is a rear perspective view of the height adjustment button.

Referring now to FIG. 4, Lock Mechanism Stem 14 extends outward from the interior surface area of Push Button 11. Lock Mechanism Diamond Tooth 15 is located on the outermost end of Lock Mechanism Stem 14. Lock Mechanism Diamond Tooth 15 is generally the same thickness as that of Downwardly Extending Male Portion 9.

Referring to FIG. 8, a cut out portion of Front Wall 6 named Front Wall Pass-Through 16 exists for the purpose of allowing a hole for Lock Mechanism Stem 14 and Lock Mechanism Diamond Tooth 15 to pass through. Referring to FIG. 11, Push Button 11 and Bezel 12 are located on the outer surface area of Front Wall 6, while Lock Mechanism Stem 14 and Lock Mechanism Diamond Tooth 15 are at rest within Front Wall Pass Through 16 and Female Cavity 23.

Referring again to FIG. 4, a compression Spring 13 nests within the under side of Push Button 11 and encircles Lock Mechanism Stem 14 and Lock Mechanism Diamond Tooth 15. As displayed in FIG. 11, Spring 13 is sandwiched between the interior surface area of Push Button 11 and the exterior surface area of Front Wall 6.

Figure 12:
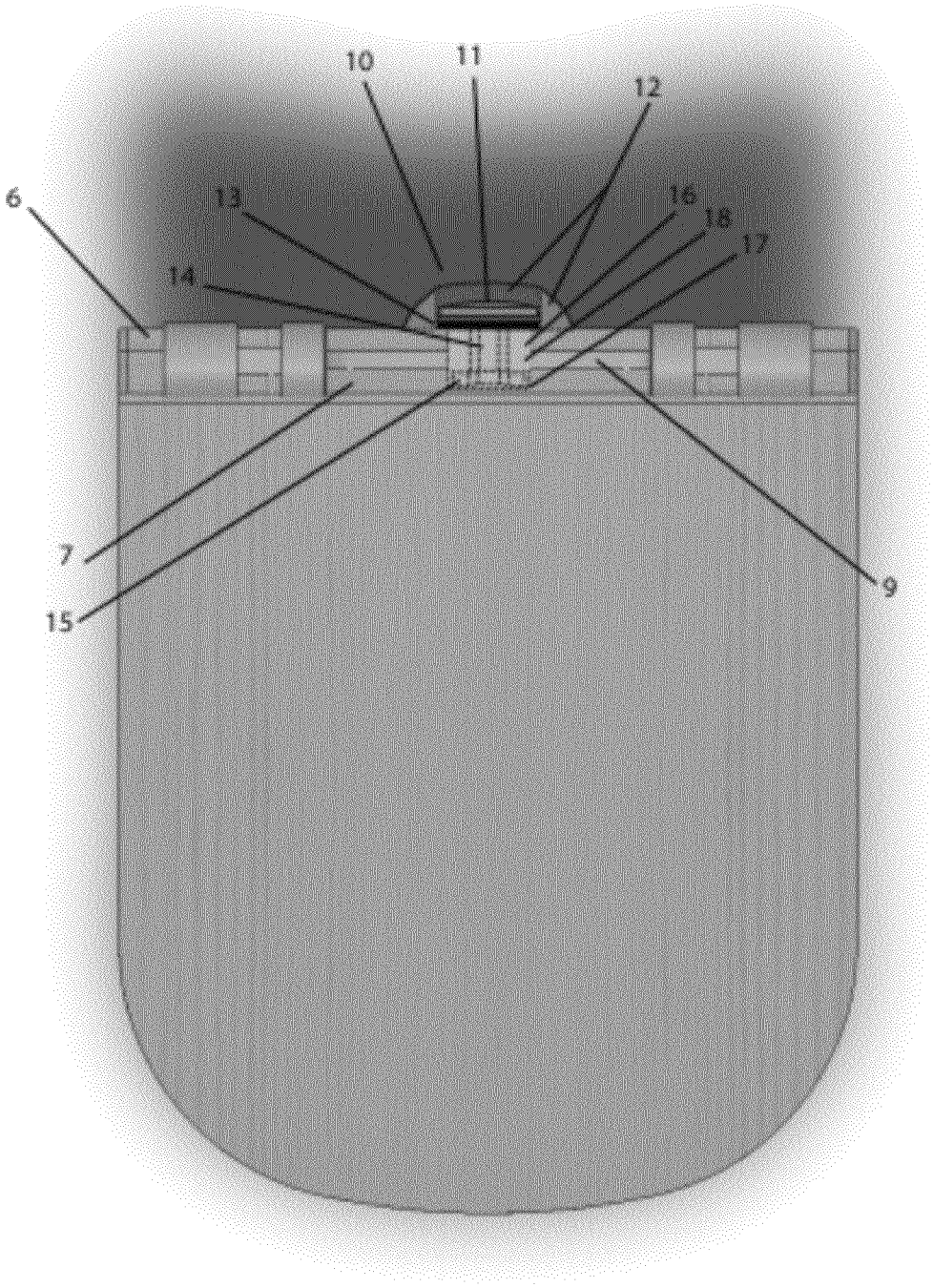
FIG. 12 is a view of the lower plate portion, upwardly extending female portion, and downwardly extending male portion of FIG. 1, and the mechanism of FIG. 5; the downwardly extending male portion is shown fully nested within said upwardly extending female portion; the lock mechanism is shown in its deployed position.
Figure 13A:
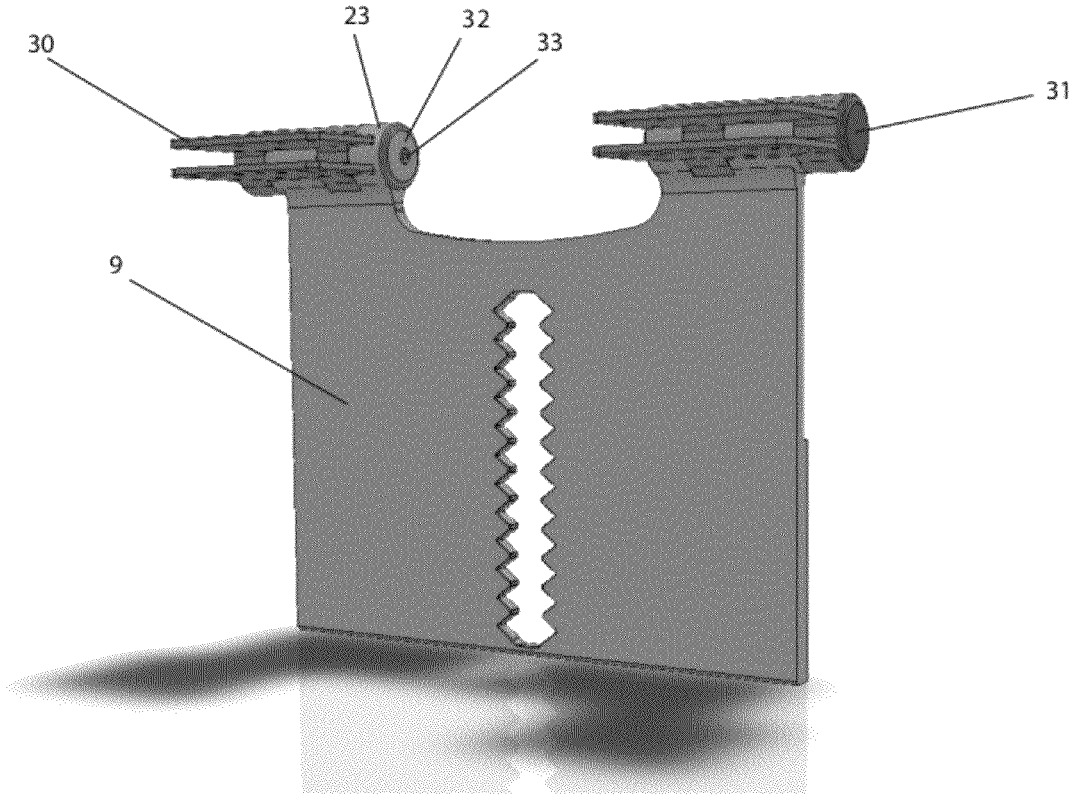
FIG. 13*a* is a forward perspective view of the hinge element used to support the upper plate portion of FIG. 1, shown without any other parts.
Figure 13B:
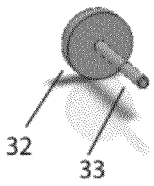
FIGS. 13*c-d* illustrate the individual elements of FIG. 13*a*, shown without any other parts.
Figure 13C:
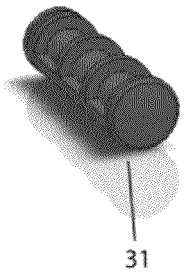
Figure 13D:
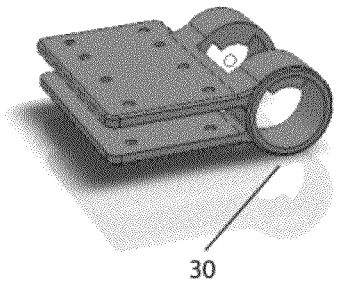

As seen in FIG. 12, when Push Button 11 is pushed inward to a deployed state, Lock Mechanism Diamond Tooth 15 travels away from Front Wall 6 toward Rear Wall 7. Briefly referring to FIG. 9, Rear Wall Tooth Bay 17 is a hollowed out cavity portion located on the interior surface of Rear Wall 7 for the purpose of receiving Lock Mechanism Diamond Tooth 15.

Referring back to FIG. 12, when Push Button 11 is fully compressed, Lock Mechanism Diamond Tooth 15 nests within Rear Wall Tooth Bay 17, allowing Downwardly Extending Male Portion 9 to move up or down within Female Cavity 23.

Figure 10:
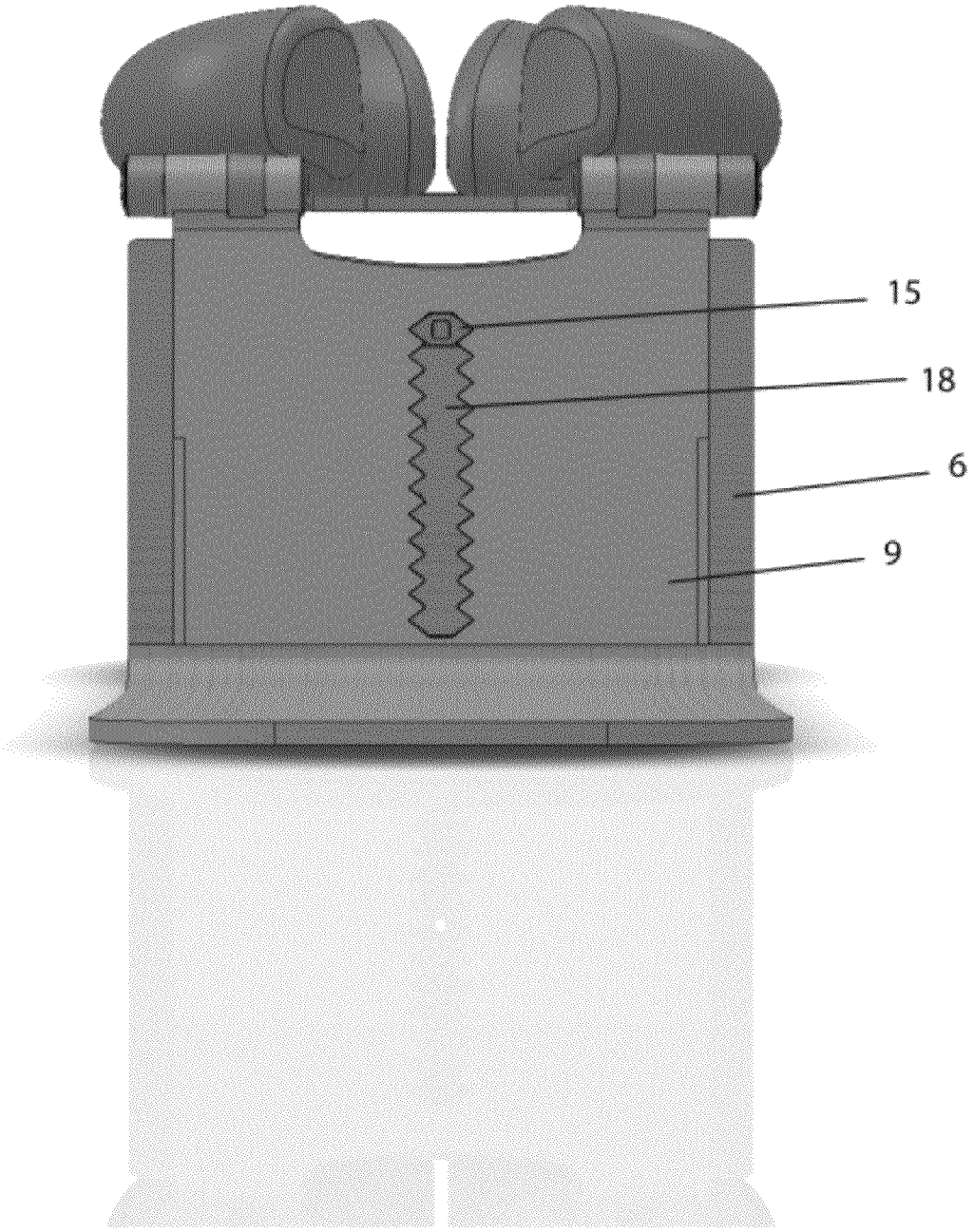
FIG. 10 is a rear perspective view of the apparatus of FIG. 1; shown without the upwardly extending female portion rear wall.

Briefly referring to FIG. 10, Height Adjustment Tooth Slots 18 is located on Downwardly Extending Male Portion 9. Referring now to FIG. 12, when Push Button 11 is pushed inward to a deployed state, thereby compressing Spring 13, and Lock Mechanism Diamond Tooth 15 is fully nested within Rear Wall Tooth Bay 17, the Push Button 11 is in its deployed state. With Push Button 11 in its deployed state, Downwardly Extending Male Portion 9 is able to slide up or down within Female Cavity 22 to adjust to a different height. When Push Button 11 is released from its deployed state, as shown in FIG. 11, Lock Mechanism Diamond Tooth 15 travels back toward the direction of Front Wall 6 and lodges within Height Adjustment Tooth Slots 18 and into a state of rest.

When the Lock Mechanism Diamond Tooth 15 mechanism of Height Adjustment Mechanism 10 is at rest in Height Adjustment Tooth Slots 18, as shown in FIG. 10, the Downwardly Extending Male Portion 9 is kept from moving up or down.

As displayed in FIG. 12, Push Button 11 is in its deployed state, with the Lock Mechanism Diamond Tooth 15 component of Height Adjustment Mechanism 10 shown inserted through Front Wall Pass-Through 16, through one of the diamond shaped cut-out elements of Height Adjustment Tooth Slots 18 found on Downwardly Extending Male Portion 9, and fully lodged within Rear Wall Tooth Bay 17.

As shown in FIG. 1, a Hanger 19 is located on the Front Wall 6 of Upwardly Extending Female Portion 5.

Figure 6:
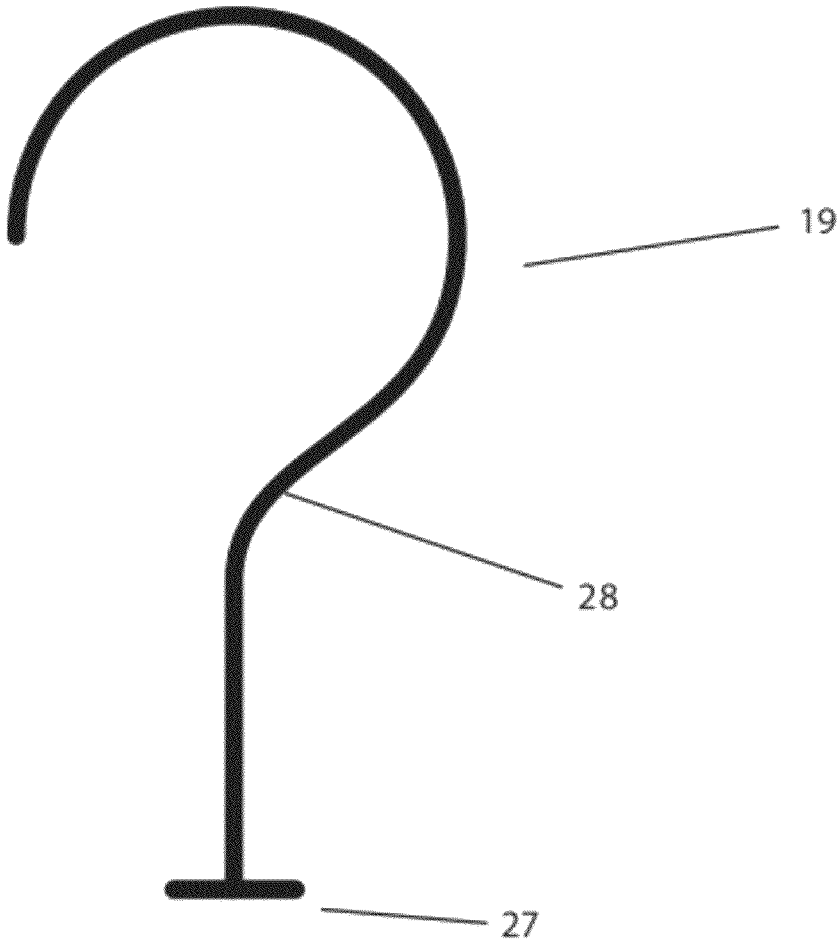
FIG. 6 depicts the hanger element of the invention.
Figure 7:
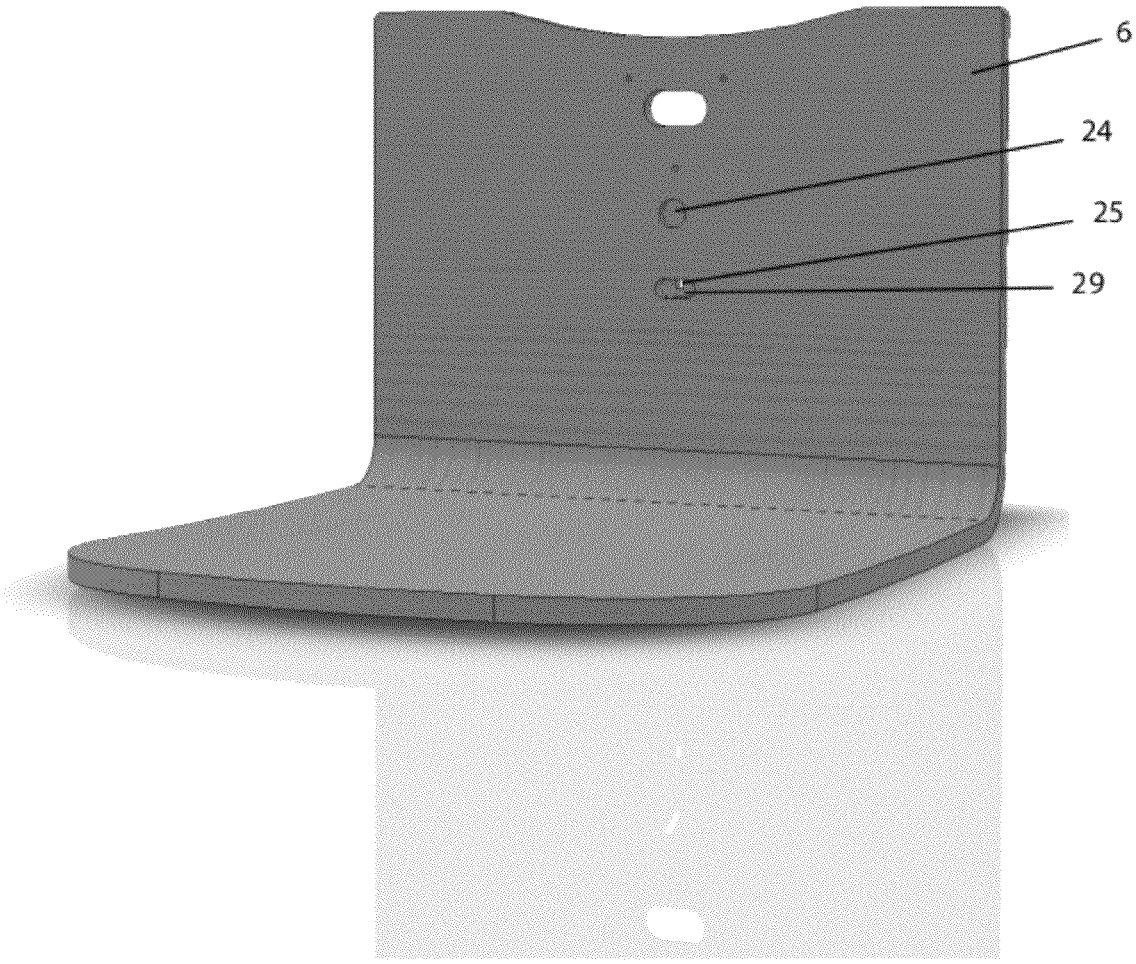
FIG. 7 is a forward perspective view of the interior surface of the upwardly extending female portion front wall of the apparatus of FIG. 1; shown without any other parts.

Referring now to FIG. 6, wherein a Hanger 19 is comprised of a Hanger T-Bar Portion 27 and Hanger Body Portion 28. Prior to joining together Front Wall 6 and Rear Wall 7 of Upwardly Extending Female Portion 5, Hanger 19 is fed through the back side of Front Wall 6 by way of Hanger Hole 25, as displayed in FIG. 7. Again referring to FIG. 7, Hanger T-Bar Bay 29 is a cavity generally shaped slightly larger than the shape of Hanger T-Bar Portion 27 with a Hanger Hole 25 located in its center large enough for the passage of Hanger Body Portion 28. After Hanger Body Portion 28 has been fed through Hanger Hole 25, the Hanger T-Bar Portion 27 of Hanger 19 nests within Hanger T-Bar Bay 29 on the interior surface area of Front Wall 6, and serves as a support member for Hanger 19 to support the weight of the apparatus when it is hung on a closet pole. When nested within Hanger T-Bar Bay 29, Hanger T-Bar Portion 27 is fully lodged within Front Wall 6.

As depicted in FIG. 8, the Hanger Body Portion 28 nests within Hanger Bay 26 on the exterior surface area of Front Wall 6. Hanger Bay 26 is a cavity or aperture generally shaped slightly larger than the shape of Hanger Body Portion 28. When nested within Hanger Bay 26, Hanger Body Portion 28 lies flush with the surface area of Front Wall 6. Hanger 19 is at rest when nested within Hanger Bay 26 on Front Wall 6 until the user lifts Hanger 19 into its deployed state, as shown in FIG. 3.

Referring back to FIG. 7, a magnet may be affixed or adhered within Magnet Bay 24 located on the interior surface area of Front Wall 6 of Upwardly Extending Female Portion 5. Magnet Bay 24 is a cavity generally shaped slightly larger than the shape of Magnet 23. When nested within Magnet Bay 24, Magnet 23 is fully lodged within Front Wall 6. Magnet Bay 24 is located directly underneath a portion of Hanger Bay 26. As such, the magnetic force of Magnet 23 is able to permeate the material of Front Wall 6, resulting in a magnetic holder for Hanger 19.

The invention described below may be fabricated from any suitable material, but the preferred embodiment is fabricated from a lightweight, high-strength material such as a wood material or ABS plastic (Acrylonitrile Butadiene Styrene).

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by any claims in any subsequent application claiming priority to this application.

For example, notwithstanding the fact that the elements of such a claim may be set forth in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings Thus, if an element can be understood in the context of this specification as including more than one meaning, then its use in a subsequent claim must be understood as being generic to all possible meanings supported by the specification and by the word itself.

The definitions of the words or elements of any claims in any subsequent application claiming priority to this application should be, therefore, defined to include not only the combination of elements which are literally set forth, but all equivalent structure, material or acts for performing substantially the same function in substantially the same way to obtain substantially the same result. In this sense, it is therefore contemplated that an equivalent substitution of two or more elements may be made for any one of the elements in such claims below or that a single element may be substituted for two or more elements in such a claim.

Although elements may be described above as acting in certain combinations and even subsequently claimed as such, it is to be expressly understood that one or more elements from a claimed combination can in some cases be excised from the combination and that such claimed combination may be directed to a subcombination or variation of a sub combination.

Insubstantial changes from any subsequently claimed subject matter as viewed by a person with ordinary skill in the art, now known or later devised, are expressly contemplated as being equivalently within the scope of such claims. Therefore, obvious substitutions now or later known to one with ordinary skill in the art are defined to be within the scope of the defined elements.

Any claims in any subsequent application claiming priority to this application are thus to be understood to include what is specifically illustrated and described above, what is conceptually equivalent, what can be obviously substituted and also what essentially incorporates the essential idea of the invention.

We claim:

1. A headrest device comprising:

an upper plate rotatably connected to a downwardly extending male portion;

a lower plate portion and a front wall portion constructed from a singular continuous material, whereby the lower plate portion outwardly depends from the front wall portion at about a 90 degree angle;

a rear wall element located behind the front wall portion defining an upwardly extending female portion having a female cavity for slideably receiving the downwardly extending male portion;

a singular, spring-loaded height adjusting means disposed on the front wall portion of the upwardly extending female portion for selectively, and even-balancedly, adjusting the vertical height of the upper plate relative to the lower plate by way of a tooth and slot structure.

2. The device of claim 1 wherein the upper plate is rotatably connected to the downwardly extending male portion by means of at least one hinge mechanism;

the hinge mechanism containing an internal stopping agent restricting rotation of the upper plate to about 180 degrees.

3. The device of claim 1 further comprising a hanger element;

the hanger element defining a hook element and affixed to the front wall element for hanging on a rail.

* * * * *